US009280946B2

(12) United States Patent
Suwabe et al.

(10) Patent No.: US 9,280,946 B2
(45) Date of Patent: Mar. 8, 2016

(54) DRIVING DEVICE OF DISPLAY MEDIUM, DISPLAY DEVICE, AND NON-TRANSITORY COMPUTER READABLE MEDIUM

(71) Applicant: FUJI XEROX CO., LTD., Tokyo (JP)

(72) Inventors: Yasufumi Suwabe, Minamiashigara (JP); Masaaki Abe, Minamiashigara (JP); Ryota Mizutani, Minamiashigara (JP); Yoshinori Machida, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 160 days.

(21) Appl. No.: 14/056,388

(22) Filed: Oct. 17, 2013

(65) Prior Publication Data

US 2014/0362125 A1 Dec. 11, 2014

(30) Foreign Application Priority Data

Jun. 5, 2013 (JP) ..... 2013-119306

(51) Int. Cl.

*G09G 3/34* (2006.01)
*G09G 3/36* (2006.01)
*G09G 3/20* (2006.01)

(52) U.S. Cl.

CPC ..... *G09G 3/3696* (2013.01); *G09G 3/2003* (2013.01); *G09G 3/2014* (2013.01); *G09G 3/2081* (2013.01); *G09G 3/344* (2013.01); *G09G 2310/0256* (2013.01)

(58) Field of Classification Search

CPC ... G09G 3/344; G09G 3/2003; G09G 3/2014; G09G 3/2081; G09G 2310/0256; G02F 1/167
See application file for complete search history.

(56) References Cited

U.S. PATENT DOCUMENTS

| | | | | |
|---|---|---|---|---|
| 6,486,866 | B1 | 11/2002 | Kuwahara et al. | |
| 2008/0117165 | A1 | 5/2008 | Machida et al. | |
| 2011/0141087 | A1 | 6/2011 | Hiji et al. | |
| 2011/0157136 | A1* | 6/2011 | Kim et al. | 345/211 |
| 2012/0008188 | A1* | 1/2012 | Telfer et al. | 359/296 |
| 2012/0139966 | A1 | 6/2012 | Mizutani et al. | |
| 2012/0200610 | A1 | 8/2012 | Sakamoto et al. | |
| 2012/0256893 | A1* | 10/2012 | Sakamoto et al. | 345/208 |
| 2013/0234923 | A1* | 9/2013 | Machida et al. | 345/107 |

FOREIGN PATENT DOCUMENTS

| | | |
|---|---|---|
| JP | A-2000-137250 | 5/2000 |
| JP | A-2004-163567 | 6/2004 |
| JP | A-2012-133310 | 7/2012 |

OTHER PUBLICATIONS

Extended European Search Report issued in European Patent Application No. 13191963.1 issued May 28, 2014.

* cited by examiner

*Primary Examiner* — Lixi C Simpson
(74) *Attorney, Agent, or Firm* — Oliff PLC

(57) ABSTRACT

A driving device of a display medium, includes: an applying unit that applies a gray level adjusting voltage including unit pulses in accordance with a gray level of a pixel to the pixel of a display medium; and a control unit that controls the applying unit so that the number of unit pulses of the gray level adjusting voltage which is applied at a movement time of each of plural types of panicle groups is equal to the number of unit pulses of the gray level adjusting voltage which is applied at the movement time of a particle group having the highest threshold value among the plural types of particle groups.

9 Claims, 14 Drawing Sheets

AFTER COMPLETING APPLICATION OF GRAY LEVEL ADJUSTING VOLTAGE V1

AFTER COMPLETING APPLICATION OF GRAY LEVEL ADJUSTING VOLTAGE -V2

AFTER COMPLETING APPLICATION OF GRAY LEVEL ADJUSTING VOLTAGE V3

DRIVING DEVICE OF DISPLAY MEDIUM, DISPLAY DEVICE, AND NON-TRANSITORY COMPUTER READABLE MEDIUM

CROSS-REFERENCE TO RELATED APPLICATIONS

This application is based on and claims priority under 35 U.S.C. 119 from Japanese Patent Application No. 2013-119306 filed on Jun. 5, 2013.

BACKGROUND

Technical Field

The present invention relates to a driving device of a display medium, a display device, and a non-transitory computer readable medium.

SUMMARY

According to an aspect of the present invention, a driving device of a display medium, includes: an applying unit that applies a gray level adjusting voltage including unit pulses in accordance with a gray level of a pixel to the pixel of a display medium in which plural types of particle groups having different colors and different movement times when the particle groups move from one of a pair of substrates to the other substrate are encapsulated, when an intensity of an electric field is fixed, the particle groups having different threshold values at which the particle groups begin to move between the pair of substrates depending on the electric field formed between the pair of substrates in which at least one of the substrates is translucent; and a control unit that controls the applying unit so that the number of unit pulses of the gray level adjusting voltage which is applied at the movement time of each of the plural types of particle groups is equal to the number of unit pulses of the gray level adjusting voltage which is applied at the movement time of a particle group having the highest threshold value among the plural types of particle groups.

BRIEF DESCRIPTION OF THE DRAWINGS

Exemplary embodiment(s) of the present invention will be described in detail based on the following figures, wherein.

DETAILED DESCRIPTION

Figure 1:
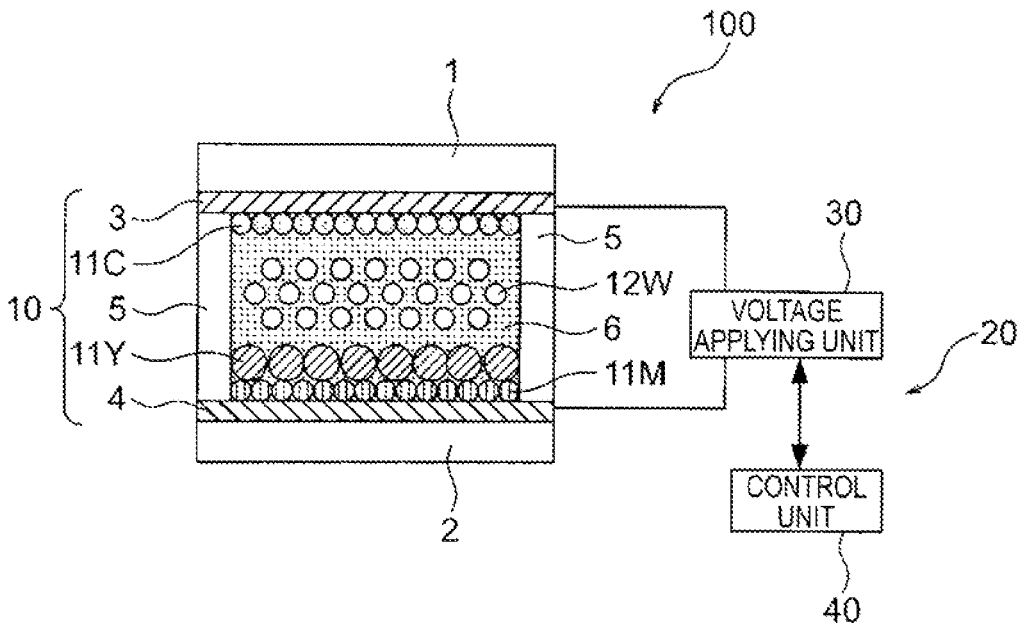
FIG. 1 is a schematic diagram illustrating a display device.

Hereinafter, an embodiment for carrying out the present invention will be described in detail with reference to the drawings. A like reference numeral may be denoted to a member which performs a like operation or function throughout the drawings and redundant description may not be provided. Further, a display medium according to an embodiment includes a plurality of pixels, but the present embodiment will be described using a drawing which concentrates on one pixel for the sake of simplification of the description.

Further, cyan is denoted by a reference symbol C, magenta is denoted by a reference symbol M, yellow is denoted by a reference numeral Y, and white is denoted by a reference symbol W and if it is required to distinguish the colors in order to describe characteristics, color reference symbols C, M, Y, and W corresponding to the colors are attached to the ends of the reference numerals to distinguish the colors.

Further, a cyan particle is denoted as a particle C, a magenta particle is denoted as a particle M, a yellow particle is denoted as a particle Y, and a white particle is denoted as a particle W and the particles and the particle groups may be denoted by the same reference symbols.

<First Embodiment>

FIG. 1 is a diagram schematically illustrating a display device 100 according to a first embodiment. The display device 100 includes a display medium 10 and a driving device 20 which drives the display medium 10. The driving device 20 includes a voltage applying unit 30 which applies a voltage between a display side electrode 3 and a rear side electrode 4 of the display medium 10 and a control unit 40 which controls the voltage applying unit 30 in accordance with color information of an image to be displayed on the display medium 10.

In the display medium 10, a translucent display substrate 1 serving as an image display surface and a rear substrate 2 serving as a non-display surface are disposed so as to be opposite to each other with a gap therebetween. Further, a gap member 5 is provided to maintain a predetermined gap between the substrates 1 and 2 and divide the gap between the substrates 1 and 2 into a plurality of partitions so that particle groups in the surface of the display medium is prevented from being concentrated. The rear side electrode 4 is formed of a plurality of electrodes and each electrode becomes a pixel, but the pixel and the partition may or may not match. Further, both the display substrate 1 and the rear substrate 2 may be translucent.

In a region interposed between the pixel and the rear side electrode 4, for example, a transparent dispersion medium 6 which is formed of an insulating liquid and a cyan particle group 11C, a magenta particle group 11M, a yellow particle group 11Y, and a white particle group 12W which are dispersed in the dispersion medium 6 are encapsulated. Here, three types of particle groups have been described but the particle groups may be two types or four types or more.

The particle group 11C, the particle group 11M, and the particle group 11Y (hereinafter, referred to as a particle group 11) according to the first embodiment are positively charged and energy which is higher than a predetermined threshold value is applied between a pair of electrodes 3 and 4 so that the particle group 11 moves between the pair of electrodes 3 and 4.

Here, the threshold value refers to energy which works on the particle group 11 attached on any one of the display substrate 1 and the rear substrate 2 and is required to cut an attracting force between the particles 11 by Van der Waals's force and an intermolecular force, an attracting force between the particle group 11 and the substrates 1 and 2, and an attracting force between the particle group 11 and the substrates 1 and 2 by an image force to separate the particle group 11 from the display substrate 1 or the rear substrate 2, that is, movement initiation energy required to initiate the movement of the particle groups 11.

The movement initiation energy of the particle group 11 depends on an intensity of the voltage which is applied between the substrates 1 and 2 and a voltage applying time.

Therefore, even though the voltage required to cut the attracting force between the particles 11 or the attracting force between the particle group 11 and the substrates 1 and 2 is applied, if the application of the voltage is stopped before reaching the threshold value, the particle group 11 is not separated from the substrates 1 and 2 and remains to be attached on any one of the substrates 1 and 2.

The threshold value which indicates a characteristic of the movement of the particle group 11 varies depending on the type of the particle group 11. In the first embodiment, for example, it is assumed that among the particle groups 11, a threshold value of the particle group 11Y is the lowest and a threshold value of the particle group 11C is the highest.

Further, there is no limitation on a charged polarity of the particle group 11 and the first embodiment does not depend on the charged polarity of the particle group 11. For example, all particle groups may be positive or negative or every particle group may have different charged polarities.

Further, diameters of both the particle 11C and particle 11M according to the first embodiment are smaller than, for example, a diameter of the particle 11Y. The particles 11C and 11M have diameters enough to escape from the gap of aggregated particles 11Y even when a voltage which is higher than a predetermined threshold value is applied between the pair of electrodes 3 and 4 so that the particles 11Y are attached on any one of the substrates to be aggregated. In addition, there is no limitation on the diameter of the particle 11 according to the first embodiment but the diameter may be appropriately set in accordance with the charged polarity or responsiveness of the particle 11.

Furthermore, the color of the particle group 11 is not limited to cyan, magenta, and yellow if different types of particle groups have different colors.

In the meantime, the particle group 12W is a particle group which has a smaller charged amount than the particle group 11 or is not charged. Therefore, even when a voltage at which the particle group 11 migrates to any one of the pair of substrates 1 and 2 is applied between the pair of electrodes 3 and 4, a migration speed of the particle group 12W is slower than a migration speed of the particle group 11 and the particle group 12W is not attached on the substrates 1 and 2 and floats in the dispersion medium 6.

The driving device 20 (the voltage applying unit 30 and the control unit 40) applies a voltage in accordance with the color information of the image to be displayed to the display side electrode 3 and the rear side electrode 4 to migrate the particle group 11 in the dispersion medium 6 to attach the particle 11 with an amount in accordance with a gray level (hereinafter, also referred to as a gray scale) of a display color corresponding to each color of the particle group 11 designated by the color information of the image, onto any one of the pair of substrates 1 and 2, to display the image on the display medium 10.

The voltage applying unit 30 is a voltage applying device that applies a voltage to the display side electrode 3 and the rear side electrode 4. The voltage applying unit 30 is electrically connected to both the display side electrode 3 and the rear side electrode 4 and is also connected to the control unit 40 to apply the voltage to the display side electrode 3 and the rear side electrode 4 in accordance with an instruction from the control unit 40.

In the first embodiment, for example, a so-called active matrix driving method is used. According to the active matrix driving method, the rear side electrode 4 is formed of a TFT electrode and n scanning lines (address lines Y1 to Yn) in a horizontal direction and m signal lines (data lines X1 to Xm) in a vertical direction form a matrix, and the rear side electrode 4 for every pixel is disposed at each of intersections of the scanning lines and the signal lines.

In this case, the scanning line is connected to a gate of the rear side electrode 4 and applies a voltage which determines to turn on/off a TFT electrode. The signal line is connected to a drain or a source of the rear side electrode 4 and applies a voltage which adjusts a gray level of a display color (hereinafter, referred to as a gray level adjusting voltage).

In other words, the rear side electrode 4 on an interconnection of wiring is electrically conducted by one Yi (i=1 to n) of the scanning lines and the gray level adjusting voltage is applied from the signal line to the rear side electrode 4. Entire scanning lines of Y1 to Yn (one frame) are scanned so that an image to be displayed on the display medium 10 is rewritten.

Accordingly, the gray level adjusting voltage according to the first embodiment includes at least one of unit pulses having a scanning time of one frame as a unit time. That is, the applying time of the gray level adjusting voltage may vary with a unit pulse width as a unit by increasing or decreasing the number of unit pulses which are included in the gray level adjusting voltage. Further, the voltage value of the gray level adjusting voltage is an average value of a height (voltage value) of the unit pulse in the applying time of the gray level adjusting voltage. In addition, the rear side electrode 4 is not limited to the TFT electrode.

In the first embodiment, it is assumed that the display side electrode 3 is set to be a ground level (0 V) and a voltage is applied to the rear side electrode 4. A potential of the display electrode may be changed in synchronization with a time of an integer multiple of a frame scanning time (so called common operation) and the potential of the rear side electrode in this case may indicate a relative potential with respect to the display electrode.

Figure 2:
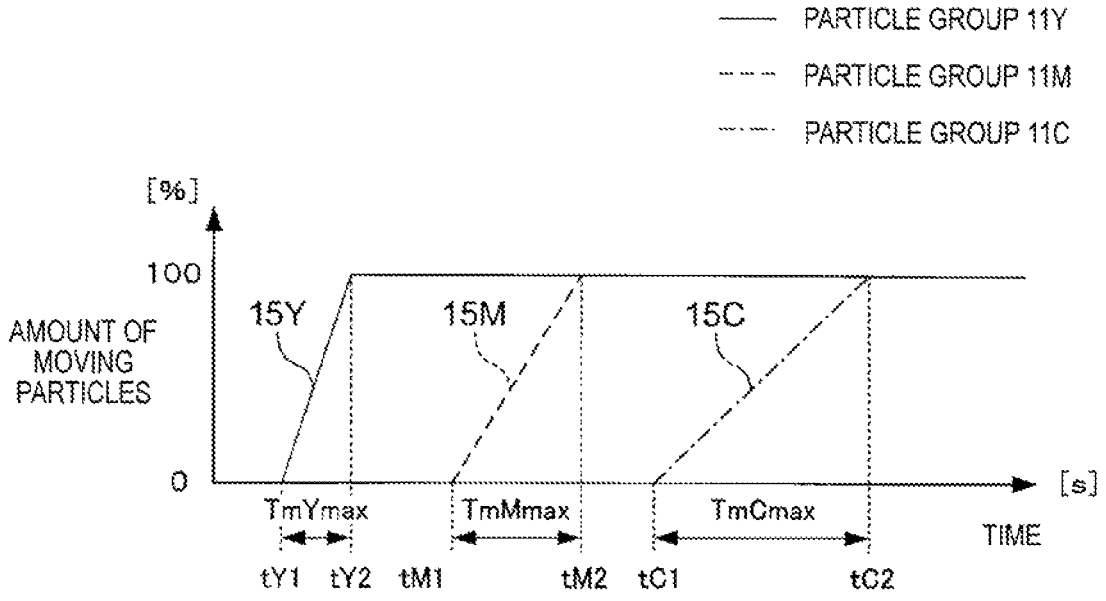
FIG. 2 is a diagram illustrating a gray scale control characteristic of a particle group.

FIG. 2 is a diagram illustrating gray scale control characteristics for each particle group 11 when a voltage with the same voltage value is applied between the electrodes 3 and 4. A characteristic 15Y represents a gray scale control characteristic of the particle group 11Y, a characteristic 15M represents a gray scale control characteristic of the particle group 11M, and a characteristic 15C represents a gray scale control characteristic of the particle group 11C.

A horizontal axis of FIG. 2 indicates an applying time of an electric field by the gray level adjusting voltage and a vertical axis indicates an amount of moving particles of the particle group 11. Here, 0% of the amount of moving particles indicates a status where all particles of the particle group 11 are attached onto the rear substrate 2 and 100% of the amount of moving particles indicates a status where all particles of the particle group 11 are attached onto the display substrate 1. In other words, a status where the amount of moving particles is 0% indicates a status where a gray level of each particle color of the particle group 11 is not visible from the display substrate 1 and a status where the amount of moving particles is 100% indicates a status where a gray level of each particle color of the particle group 11 which is visible from the display substrate 1 is a maximum gray level.

As seen from FIG. 2, a time required to change the amount of moving particles from 0% to 100% (hereinafter, referred to as a movement time) is shortest for the particle group 11Y which has the lowest threshold value among the particle groups 11 as a time TmYmax and the time is longest for the particle group 11C which has the highest threshold value among the particle groups 11 as a time TmCmax.

That is, when the gray scale for the particle groups 11 is controlled by applying gray level adjusting voltages with the same voltage value between the electrodes 3 and 4 of the pixel which includes the particle group 11 having the characteristics 15Y, 15M, and 15C, there may be a difference of movement times between the particle groups which are included in the particle group 11 so that the number of unit pulses which are included in the gray level adjusting voltage which is applied during the movement time may be different between the particle groups which are included in the particle group 11.

As described above, a variable unit of the applying time of the gray level adjusting voltage is the unit pulse width so that a particle group having a higher threshold value may have more gray scale numbers which may be obtained and a particle group having a lower threshold value may have less gray scale number which may be obtained.

Specifically, for example, when an intensity of the electric field between the electrodes 3 and 4 is 0.3 V/μM, the movement time TmYmax is 0.1 s, the movement time TmMmax is 0.3 s, and the movement time TmCmax is 0.5 s. Accordingly, for example, when the unit pulse width is 0.02 s (50 Hz), if a case where the gray level adjusting voltage is not applied is also included, the gray scale number which may be obtained by the particle group 11Y is six steps, the gray scale number which may be obtained by the particle group 11M is 16 steps, and the gray scale number which may be obtained by the particle group 11C is 26 steps.

Therefore, even when the display quality of the image to be displayed on the display medium 10 is improved by increasing the gray scale number, the gray scale numbers may vary for every display color of the particle group 11 or a gray scale of other display colors is matched with a display color having the smallest number of gray scales, so that the gray scale number may be one of limitations on improving the display quality of the image.

Therefore, the inventors of the present invention found a correlation between an intensity of the electric field and the movement time as a result of consideration by varying the intensity of the electric field which is applied to the particle group 11.

Figure 3:
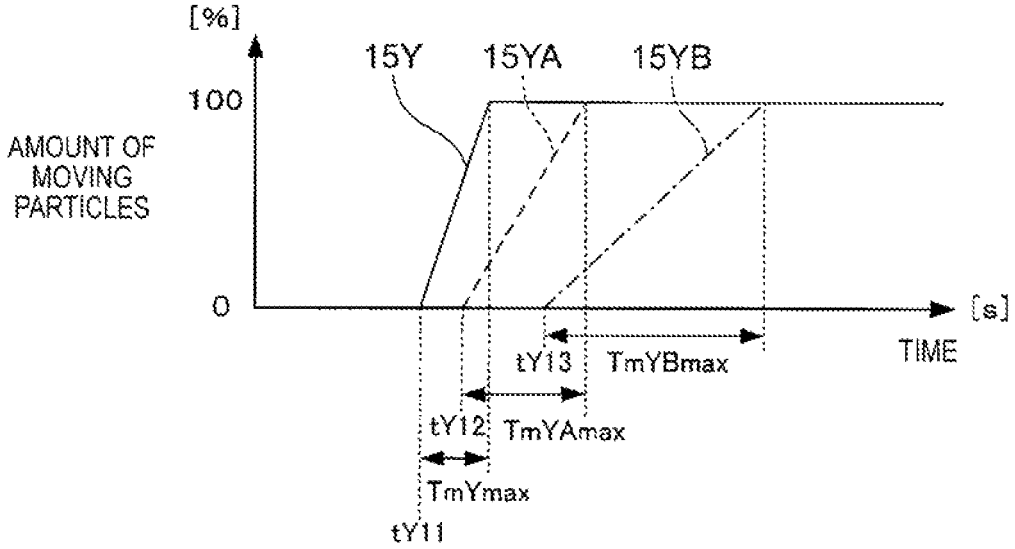
FIG. 3 is a diagram illustrating a gray scale control characteristic when an intensity of an electric field which is applied to the particle group is changed.

FIG. 3 is a diagram illustrating an example of a relation between the intensity of the electric field which is applied to the particle group 11Y and the movement time. The characteristic 15Y indicates a gray scale control characteristic of the particle group 11Y when the intensity of the electric field is set to be 0.3 V/μM similarly to the characteristic 15Y illustrated in FIG. 2, a characteristic 15YA indicates a gray scale control characteristic of the particle group 11Y when the intensity of the electric field is set to be 0.2 V/μM, and a characteristic 15YB indicates a gray scale control characteristic of the particle group 11Y when the intensity of the electric field is set to be 0.1 V/μM.

From a fact that a time required until the gray level of the particle group 11Y starts to change is set as tY11<tY12<tY13 and the movement time is set as TmYmax<TmYAmax<TmYBmax, it is understood that as the intensity of the electric field is lower, the time required to start to change the gray level of the particle group 11Y is increased and the movement time is also increased.

Specifically, as an example, the movement time TmYmax is 0.1 s, the movement time TmYAmax is 0.3 s, and the movement time TmYBmax is 0.5 s.

That is, for example, both the movement time TmCmax of the particle group 11C when the intensity of the electric field is set to be 0.3 V/μM and the movement time TmYBmax of the particle group 11Y when the intensity of the electric field is set to be 0.1 V/μM are 0.5 s. For example, when the unit pulse width of the gray level adjusting voltage is set to be 0.02 s, both the gray scale number which may be obtained by the particle group 11Y and the gray scale number which may be obtained by the particle group 11C are 26 steps.

Therefore, when the gray scales of the particle groups which are included in the particle group 11 are controlled, if the voltage value of the gray level adjusting voltage which is applied between electrodes 3 and 4 is adjusted to be lower as the threshold value of the particle group among the particle groups 11 becomes lower, the gray scale numbers which may be obtained by the particle group 11C, the particle group 11M, and the particle group 11Y become equal to each other.

Figure 4:
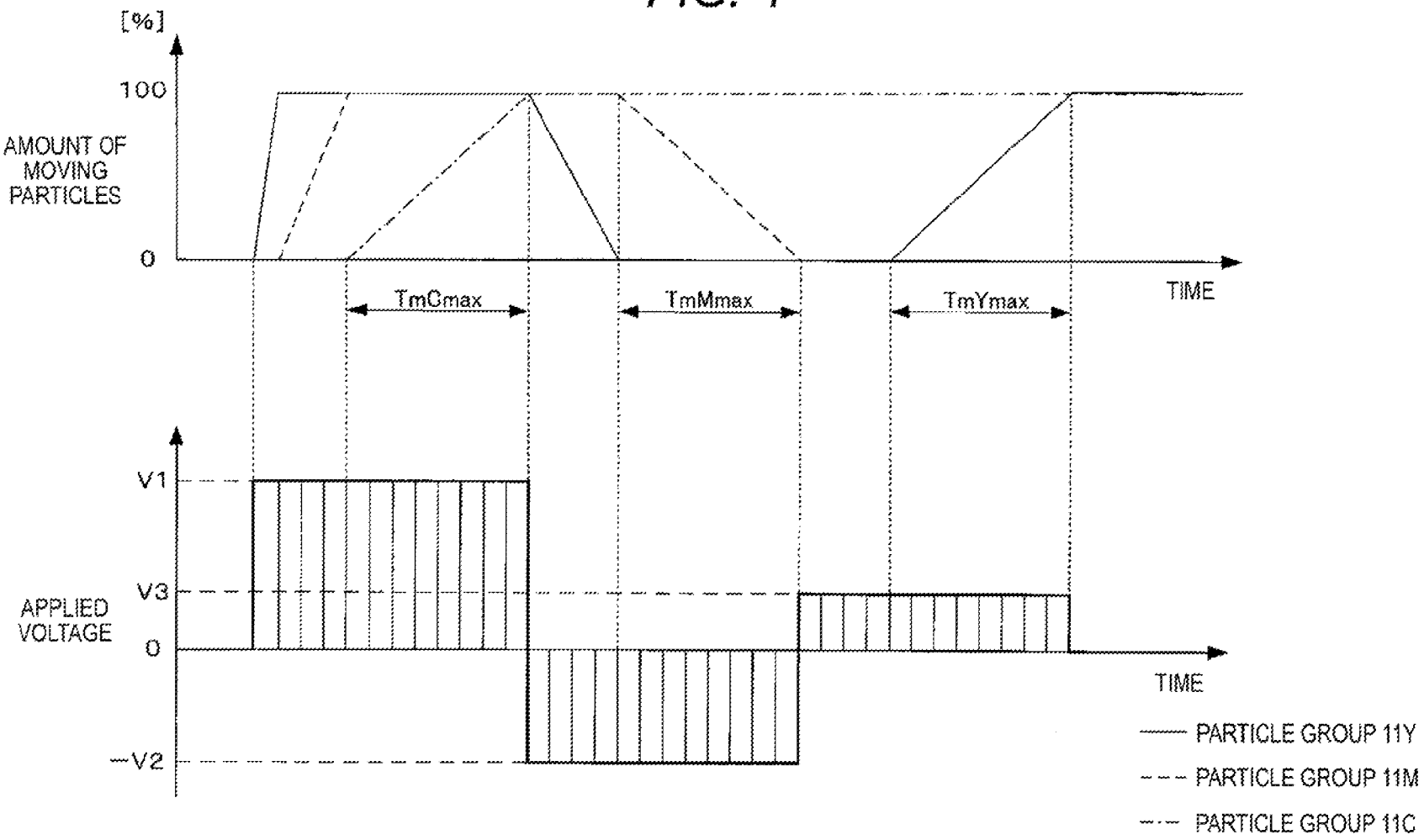
FIG. 4 is a diagram illustrating a case when gray scale numbers which may be obtained by particle groups are set to be equal to each other.

FIG. 4 illustrates the status and the value of the gray level adjusting voltage is set such that the movement time TmCmax of the particle group 11C, the movement time TmMmax of the particle group 11M, and the movement time TmYmax of the particle group 11Y are equal to each other.

Here, the value of the gray level adjusting voltage is set to be |V3|<|V2|<|V1|. When the gray scale for the particle group 11C is controlled, the gray level adjusting voltage V1 is applied. Further, when the gray scale for the particle group 11M is controlled, the gray level adjusting voltage −V2 is applied and when the gray scale for the particle group 11Y is controlled, the gray level adjusting voltage V3 is applied.

In this case, the numbers of unit pulses which are included in the movement time TmYmax, the movement time TmMmax, and the movement time TmCmax become equal to each other, so that the gray scale numbers which may be obtained by the particle groups included in the particle group 11 become equal to each other.

Further, a fact that each of the gray level adjusting voltages V1, −V2, and V3 is divided into a plurality of regions indicates that the applied voltage is configured by a plurality of unit pulses.

Figure 5:
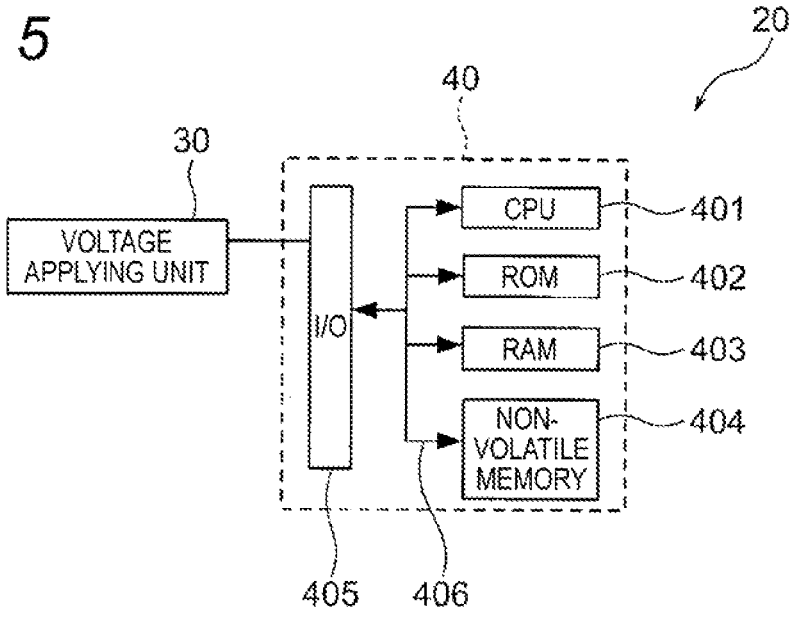
FIG. 5 is a block diagram illustrating a configuration of main parts of an electric system of a driving device.

FIG. 5 is a diagram illustrating a configuration of main parts of an electric system of the driving device 20 according to the first embodiment.

The control unit 40 of the driving device 20 is configured by a computer 40, for example. The computer 40 has a configuration in which a central processing unit (CPU) 40, a read only memory (ROM) 402, a random access memory (RAM) 403, a non-volatile memory 404, and an input/output interface (I/O) 405 are connected through a bus 406 and the voltage applying unit 30 is connected to the I/O 405.

Further, the non-volatile memory 404 may be connected to an external device of the computer 40 through the I/O 405 and for example, may be an external storage device such as a memory card.

Hereinafter, a driving process will be described. According to the driving process, when the image is displayed on the display medium 10, the CPU 401 reads and executes a program which controls a voltage which is applied to each pixel, so that the gray scale numbers which may be obtained by the particle groups included in the particle group 11 match with each other and the display color corresponding to the color of the particle group 11 is controlled by the gray scale of the color information of the image.

In this case, the program may be installed in the ROM 402 in advance but may be provided so as to be stored in a computer readable recording medium, such as a CD-ROM or a memory card, or distributed through a wired or wireless communication unit.

First, referring to FIG. 6, an operation of the display device 100 when the driving process according to the first embodiment is performed will be described.

Figure 6:
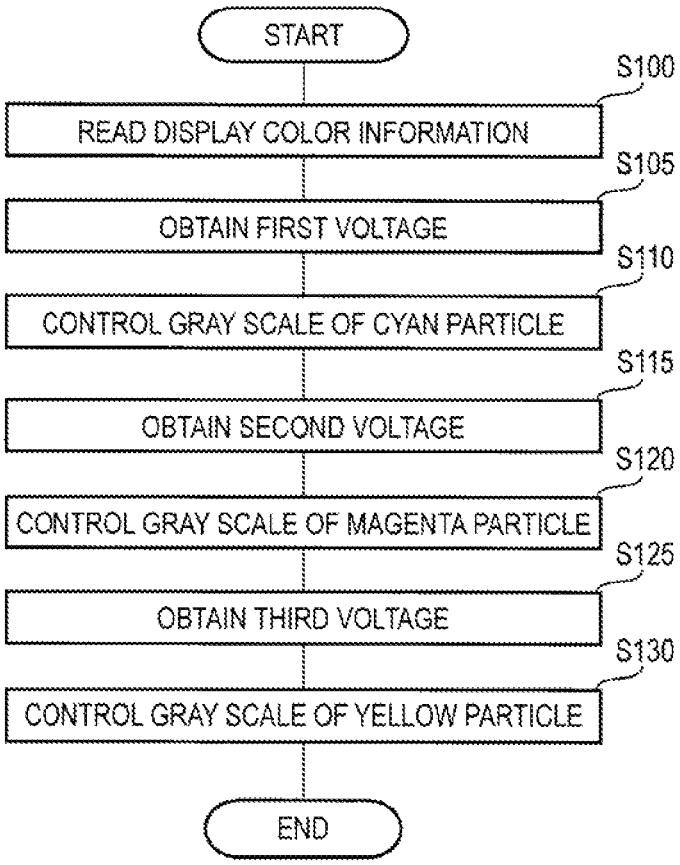
FIG. 6 is a flow chart of a driving process according to first and fourth embodiments.

Further, FIG. 6 is a flow chart illustrating a flow of a process of a driving program of the display medium 10 which is executed by the CPU 401 and the program is stored in a predetermined region of the ROM 402 in advance and executed by the CPU 401 whenever the image is requested to be displayed on the display medium 10.

Further, as an example, it is described that before performing the driving process of FIG. 6, the particle group 11 is attached onto the rear substrate 2 in advance.

In step S100, for example, the color information of the image displayed on the display medium 10 which is stored in the predetermined region of the non-volatile memory 404 in advance is obtained.

Here, the color information of the image is information which uniquely represents a display color for every pixel of the image, such as RGB data or CMY data and the color information of the image according to the first embodiment may be given as, for example, gray scale values of cyan, magenta, and yellow corresponding to the colors of the particle group 11.

In step S105, a first voltage which is used to control a gray scale of the display color of the particle group which has the highest threshold value among the particle groups 11 is obtained.

The first voltage is set as a voltage which equalizes the movement times of the particle groups with colors which are included in the particle groups 11, calculated by an experiment by an actual display device 100 or a computer simulation based on a design specification of the display device 100 in advance and stored in a predetermined region of the non-volatile memory 404 in advance.

In the first embodiment, specifically, as the first voltage at which the gray scale of the particle group 11C is controlled, a voltage V1 is obtained.

In step S110, first, a time (hereinafter, referred to as a preliminary time) when a voltage which separates a particle group (in this case, the particle group 11M and the particle group 11Y) having a threshold value which is lower than a threshold value of a particle group (in this case, the particle group 11C) whose gray scale will be controlled from any one of the substrates 1 and 2 and attaches the particle group onto the other substrate and corresponds to a voltage until the gray scale of the particle group whose gray scale will be controlled starts to be changed (hereinafter, referred to as a preliminary voltage) is applied is obtained.

In the first embodiment, the first voltage V1 obtained in step S105 is set as the preliminary voltage and the preliminary time for the preliminary voltage V1 is obtained from a preliminary time table which is stored in the predetermined region of the non-volatile memory 404 in advance.

The preliminary time table is a table in which a relation between the preliminary voltage and the preliminary time is described and the table is determined by the experiment by the actual display device 100 or the computer simulation based on a design specification of the display device 100.

Further, the preliminary time may be set to be equal to or longer than a time required to separate the particle group 11M and the particle group 11Y from any one of the substrates 1 and 2 and attach all particles of the particle group 11M and the particle group 11Y onto the other substrate.

Next, when the first voltage V1 is set as a gray level adjusting voltage to apply the gray level adjusting voltage, a time (hereinafter, referred to as a gray level adjusting time) to set as a gray scale of a color (in this case, cyan) designated by the color information of the image obtained in step S100 is obtained from a gray level adjusting time table which is stored in the predetermined region of the non-volatile memory 404 in advance.

The gray level adjusting time table is a table in which a relation between the gray level adjusting voltage, the gray scale of the display color corresponding to each color of the particle group 11, and the gray level adjusting time is described and the table is obtained by the experiment by the actual display device 100 or the computer simulation based on a design specification of the display device 100 in advance.

The obtained preliminary voltage, the preliminary time, the gray level adjusting voltage, and the gray level adjusting time are notified to the voltage applying unit 30 together with the instruction to apply a voltage.

When the voltage applying unit 30 receives a voltage applying instruction from the control unit 40, the voltage applying unit 30 applies a preliminary voltage between the electrodes 3 and 4 during the preliminary time and then applies the gray level adjusting voltage during the gray level adjusting time and displays cyan in accordance with the gray scale designated by the color information of the image on the pixel of the display medium 10.

Further, until the gray level adjusting voltage is applied between the electrodes 3 and 4 and the movement time has elapsed, the process does not proceed to the next step St 15.

In step S115, similarly to the processing of step S105, a second voltage which is used to control a gray scale of the display color of a particle group having the highest threshold value from a type of particle group which is not set as a gray scale control target among the particle groups 11 is obtained from the predetermined region of the non-volatile memory 404.

Similarly to the first voltage, the second voltage is also set to a voltage at which the movement times of the particle groups of respective colors included in the particle groups 11 are equalized in advance. In the first embodiment, specifically, a voltage −V2 is obtained as the second voltage at which the gray scale of the particle group 11M is controlled.

In step S120, the same processing as the gray scale control for the particle group 11C which is described in step S110 is performed on the particle group 11M whose gray scale will be controlled.

In this case, both the preliminary voltage and the gray level adjusting voltage are set to be the second voltage −V2. When the voltage applying unit 30 receives a voltage applying instruction from the control unit 40, the voltage applying unit 30 applies a preliminary voltage between the electrodes 3 and 4 during the preliminary time and then applies the gray level adjusting voltage during the gray level adjusting time to display magenta in accordance with the gray scale designated by the color information of the image on the pixel of the display medium 10.

Further, until the gray level adjusting voltage is applied between the electrodes 3 and 4 and the movement time has elapsed, the process does not proceed to the next step S125.

In step S125, similarly to the processing of step S115, a third voltage which is used to control a gray scale of the display color of a particle group having the highest threshold value from a type of a particle group which is not set as a gray scale control target among the particle groups 11 is obtained from the predetermined region of the non-volatile memory 404.

Similarly to the first voltage and the second voltage, the third voltage is a voltage at which the movement times of the particle groups of respective colors included in the particle group 11 are equalized. In the first embodiment, specifically, a voltage V3 is obtained as the third voltage at which the gray scale of the particle group 11Y is controlled.

In step S130, the same processing as the gray scale control for the particle group 11C which is described in step S110 is performed on the particle group 11Y whose gray scale will be controlled.

In this case, both the preliminary voltage and the gray level adjusting voltage are set to be the third voltage V3. When the voltage applying unit 30 receives a voltage applying instruction from the control unit 40, the voltage applying unit 30 applies a preliminary voltage between the electrodes 3 and 4 during the preliminary time and then applies the gray level adjusting voltage during the gray level adjusting time to display yellow in accordance with the gray scale designated by the color information of the image on the pixel of the display medium 10.

Further, until the gray level adjusting voltage is applied between the electrodes 3 and 4 and the movement time has elapsed, the driving process does not end.

The driving process described in FIG. 6 will be specifically described with reference to FIGS. 7 and 8.

Figure 7:
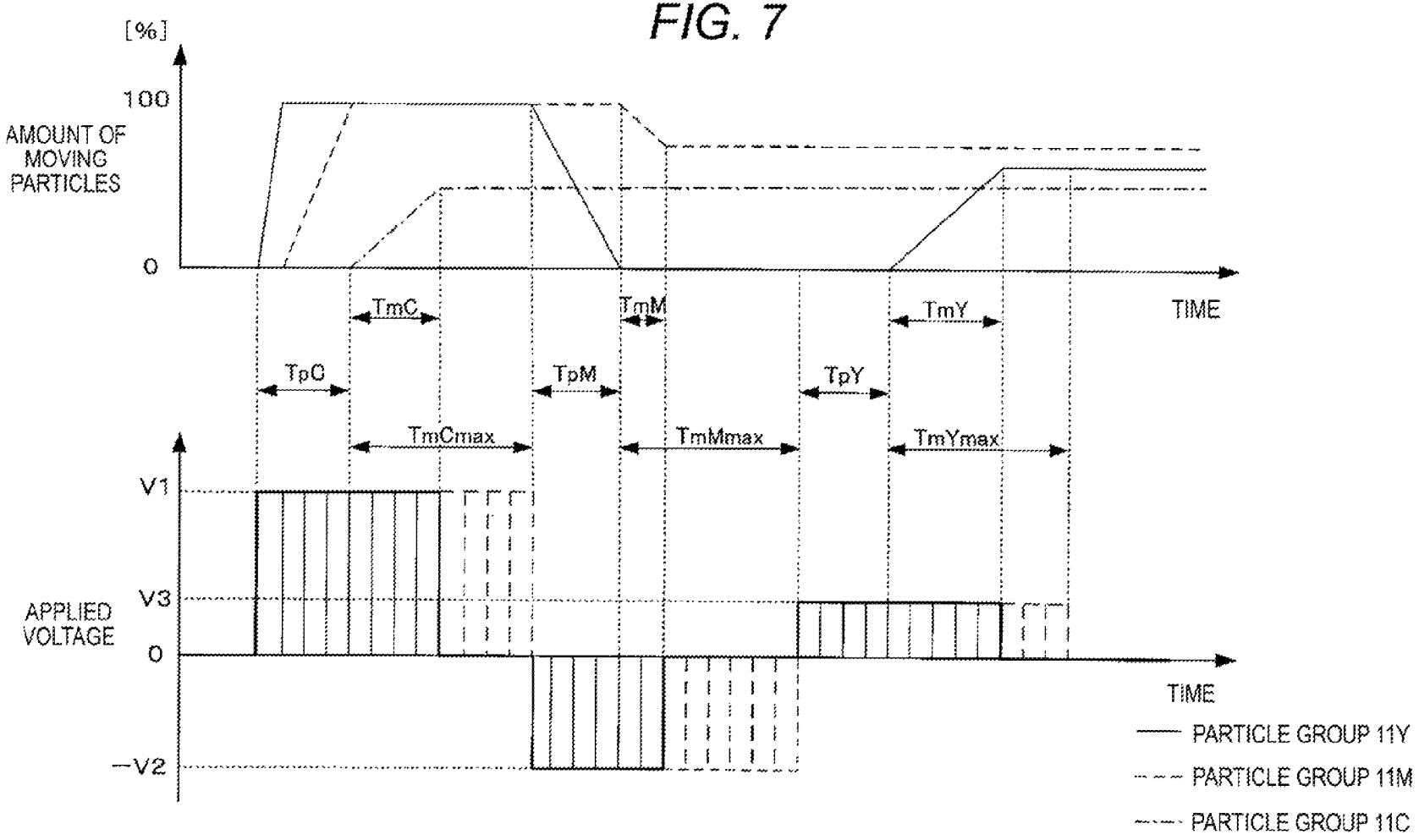
FIG. 7 is a timing chart of a driving process according to the first embodiment.
Figure 8A:
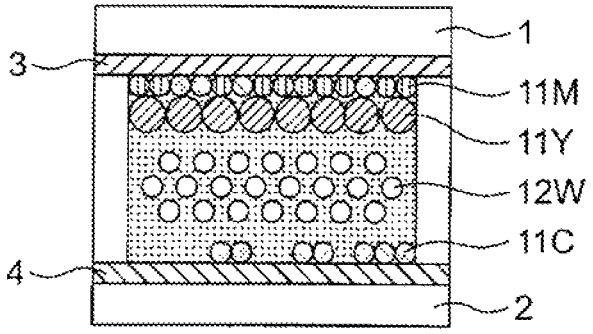
FIGS. 8A to 8C are schematic diagrams illustrating a behavior of a particle group in accordance with an applied voltage.
Figure 8B:
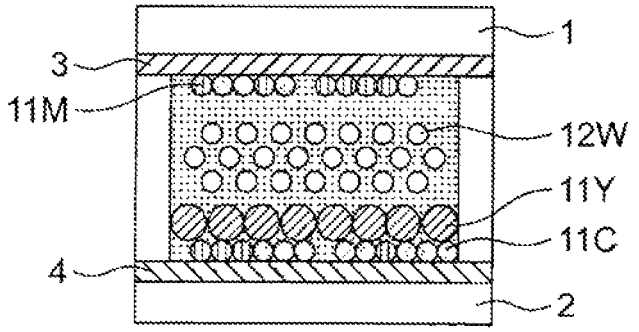
Figure 8C:
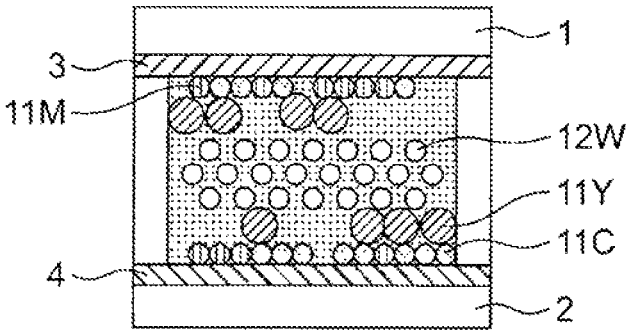

FIG. 7 is a timing chart illustrating the driving process described in FIG. 6 along a time axis and FIGS. 8A to 8C are diagrams illustrating a status of particles in the pixel of the display medium 10 at that time.

The first voltage is set as V1 in step S105, the second voltage is set as −V2 in step S115, and the third voltage is set as V3 in step S125 so that the movement time TmCmax of the particle group 11C, the movement time TmMmax of the particle group 11M, and the movement time TmYmax of the particle group 11Y are equalized and the numbers of unit pulses included in the respective movement times are equalized so that the gray scale numbers of the cyan, magenta, and yellow corresponding to respective colors of the particle group 11 are set to be equal to each other.

For example, in step S110, when the preliminary time obtained from the preliminary time table is TpC and the gray level adjusting time obtained from the gray level adjusting time table is TmC, the particle group 11M and the particle group 11Y move to the display substrate 1 during the preliminary time TpC when the preliminary voltage V1 is applied. Thereafter, the gray level adjusting voltage V1 is applied at the gray level adjusting time TmC so that cyan in accordance with the gray scale designated by the color information of the image is displayed.

FIG. 8A is a diagram illustrating the status of the particle in the pixel after completing application of the gray level adjusting voltage V1. The particle group 11M and the particle group 11Y move to the display substrate 1 while the particle 11C with an amount of particles in accordance with the gray scale of the particle group 11C moves to the display substrate 1.

Further, for example, in step S120, when the preliminary time obtained from the preliminary time table is TpM and the gray level adjusting time obtained from the gray level adjusting time table is TmM, the particle group 11Y moves to the rear substrate 2 during the preliminary time TpM when the preliminary voltage −V2 is applied. Thereafter, the gray level adjusting voltage −V2 is applied at the gray level adjusting time TmM, so that magenta in accordance with the gray scale designated by the color information of the image is displayed.

FIG. 8B is a diagram illustrating the status of the particle in the pixel after completing application of the gray level adjusting voltage −V2. The particle group 11Y moves to the rear substrate 2 while the particle 11M with an amount of particles in accordance with the gray scale of the particle group 11M remains in the display substrate 1 and the other remaining particles 11M move to the rear substrate 2.

Further, for example, in step S130, when the preliminary time obtained from the preliminary time table is TpY and the gray level adjusting time obtained from the gray level adjusting time table is TmY, the preliminary voltage V3 is applied during the preliminary time TpY which is a period until the gray scale of the particle group 11Y begins to be changed. Thereafter, the gray level adjusting voltage V3 is applied at the gray level adjusting time TmY so that yellow in accordance with the gray scale designated by the color information of the image is displayed.

FIG. 8C is a diagram illustrating the status of the particle in the pixel after completing application of the gray level adjusting voltage V3. The particle 11Y with an amount of particles in accordance with the gray scale of the particle group 11Y moves to the display substrate 1.

Further, the preliminary time TpC may be set to a time required to separate the particle group 11M and the particle group 11Y from the rear substrate 2 and attach all particles of the particle group 11M and the particle group 11Y onto the display substrate 1 but may be also set to a time required to attach all particles 11 of at least the particle group 11M onto the display substrate 1.

This is because if the amount of moving particles of the particle group 11M is not 100% after applying the gray level adjusting voltage V1, thereafter, even though the gray level adjusting voltage −V2 at which the gray scale for the particle group 11M is controlled is applied, it is difficult to control the gray scale of the particle group 11M at 100%.

In the meantime, for the particle group 11Y, even when the amount of moving particles of the particle group 11Y is not 100% after applying the gray level adjusting voltage V1, the gray level adjusting voltage V3 at which the gray scale for the particle group 11Y is controlled is applied so that the gray scale of the particle group 11Y becomes 100%.

However, if there is a limitation on a length of the preliminary time TpC and for example, only the particle 11M with 90% of an amount of particles of the particle group 11M is attached onto the display substrate 1 within a period of the preliminary time TpC, the gray scale of magenta to be displayed by the particle 11M with 90% of the amount of particles may be 100% of gray scale.

To this end, for example, a process that sets the amount of particles of the particle group 11M included in the pixel to be larger than the amount of the particles of the particle group 11Y may be performed.

Further, there is no need to change the gray scale of the display color, so that the preliminary voltage needs to be applied even when the gray level adjusting voltage is not applied.

Figure 9:
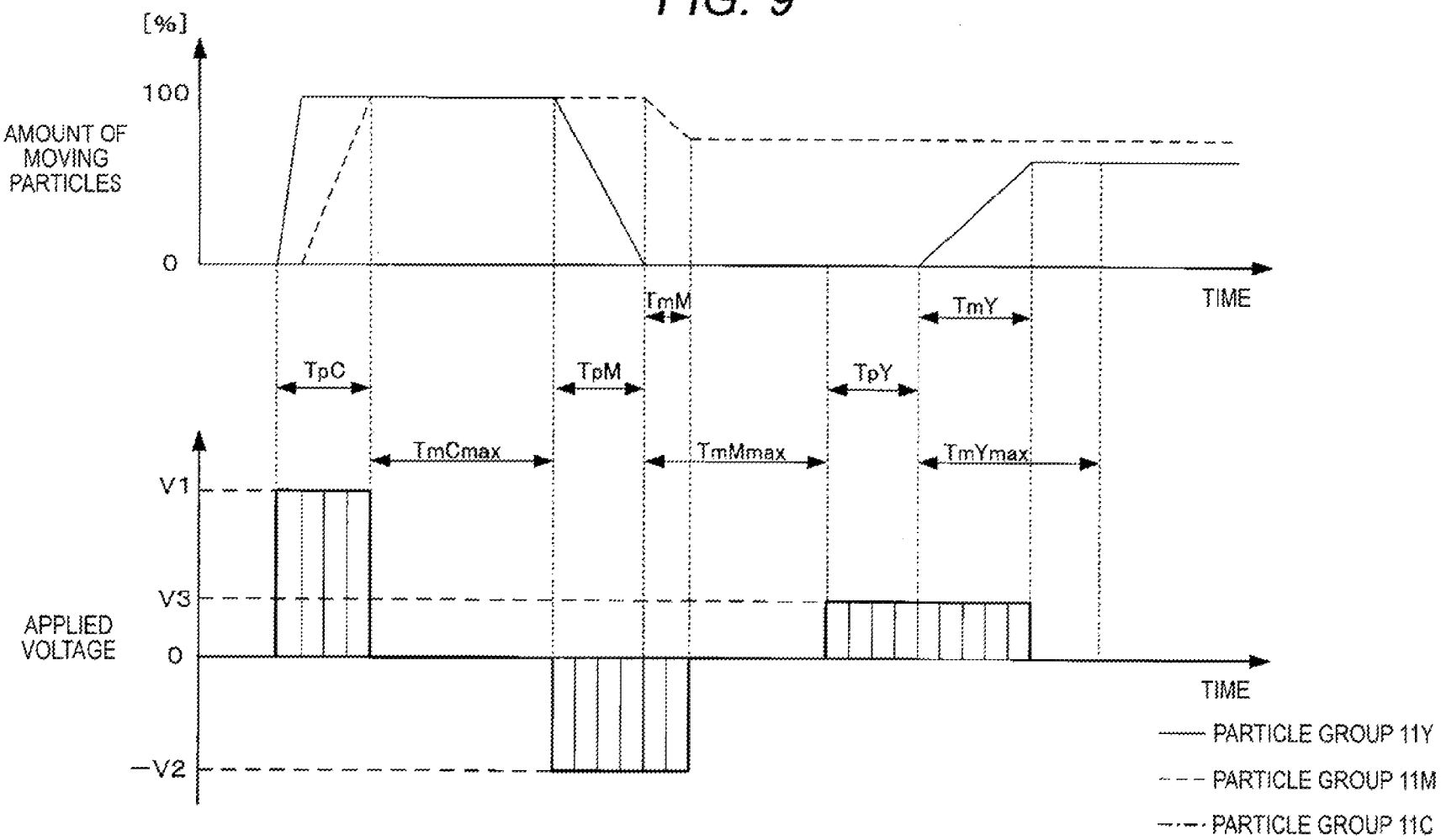
FIG. 9 is a timing chart of a driving process when a particle movement amount of a cyan particle is set to be 0%.

FIG. 9 is a timing chart illustrating a driving process when the gray scale of the particle group 11C is not changed while the amount of moving particles is 0% along the time axis.

In this case, as illustrated in FIG. 9, the gray level adjusting voltage is not applied during the movement time TmCmax for the particle group 11C but the preliminary voltage V1 is applied during the preliminary time TpC.

This is because even though there is no need to control the gray scale of the particle group 11C, the particle group 11M and the particle group 11Y need to be moved from the rear substrate 2 to the display substrate 1 in order to control the gray scale for the particle group 11M and the particle group 11Y which will be performed after controlling the gray scale for the particle group 11C.

As described above, according to the first embodiment, even when the threshold values of the particle groups included in the particle group 11 are different from each other, the voltage values of the gray level adjusting voltages which are applied to the particle groups in accordance with the threshold value are adjusted to set the gray scale number which may be obtained by the particle groups included in the particle groups 11 to be equal to each other.

Therefore, an effect that the display quality of the image is improved is expected. Further, in the first embodiment, for example, the preliminary time TpC may be recorded in the table so as to match with TmC for controlling the gray scale of the particles 11C to obtain a value of the control time corresponding to TpC+TmC.

<Second Embodiment>

Next, referring to FIG. 10, an operation of the display device 100 when the driving process according to a second embodiment is performed will be described.

In the second embodiment, the setting of the preliminary voltage is different from that of the first embodiment but the other processes and configuration are the same as those of the first embodiment.

Figure 10:
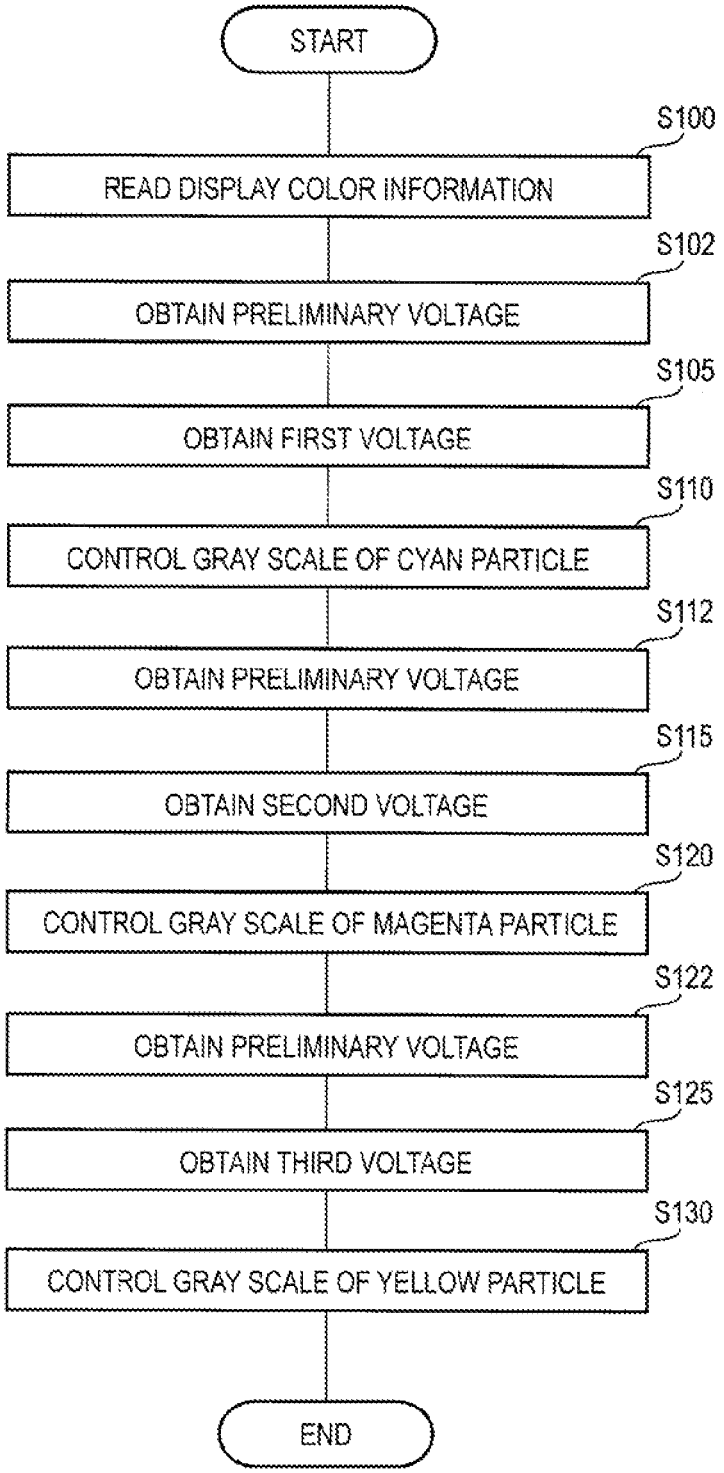
FIG. 10 is a flow chart of a driving process according to a second embodiment.

FIG. 10 is a flow chart illustrating a flow of a process of a driving program of a display medium 10 of the second embodiment which is executed by a CPU 401 and the program is stored in a predetermined region of a ROM 402 in advance and executed by the CPU 401 whenever the image is requested to be displayed on the display medium 10.

Further, the difference from the flow chart of FIG. 6 according to the first embodiment is that steps S102, S112, and S122 are added.

In step S102, for example, a preliminary voltage for a particle group 11C which is stored in a predetermined region of a non-volatile memory 404 in advance is obtained.

In this case, in the predetermined region of the non-volatile memory 404, as the preliminary voltage for the particle group 11C, a gray level adjusting voltage for a particle group having the highest threshold value among the particle groups 11, that is, a voltage V1 is set in advance.

In step S110, a voltage of the preliminary voltage is set to be V1 and the preliminary voltage V1 is applied during a preliminary time TpC.

In step S112, similarly to the process of step S102, for example, a preliminary voltage for a particle group 11M which is stored in the predetermined region of the non-volatile memory 404 in advance is obtained.

In this case, in the predetermined region of the non-volatile memory 404, as the preliminary voltage for the particle group 11M, a voltage −V1 which has the same voltage value as the preliminary voltage for the particle group 11C and a different polarity is set in advance.

In step S120, a voltage of the preliminary voltage is set to be −V1 and the preliminary voltage −V1 is applied during a preliminary time TpM.

In step S122, similarly to the process of step S102 and step S112, for example, a preliminary voltage for a particle group 11Y which is stored in the predetermined region of the non-volatile memory 404 in advance is obtained.

In this case, in the predetermined region of the non-volatile memory 404, as the preliminary voltage for the particle group 11Y, a voltage V1 is set in advance to be the same as the preliminary voltage for the particle group 11C.

In step S130, a voltage of the preliminary voltage is set to be V1 and the preliminary voltage V1 is applied during a preliminary time TpY.

Figure 11:
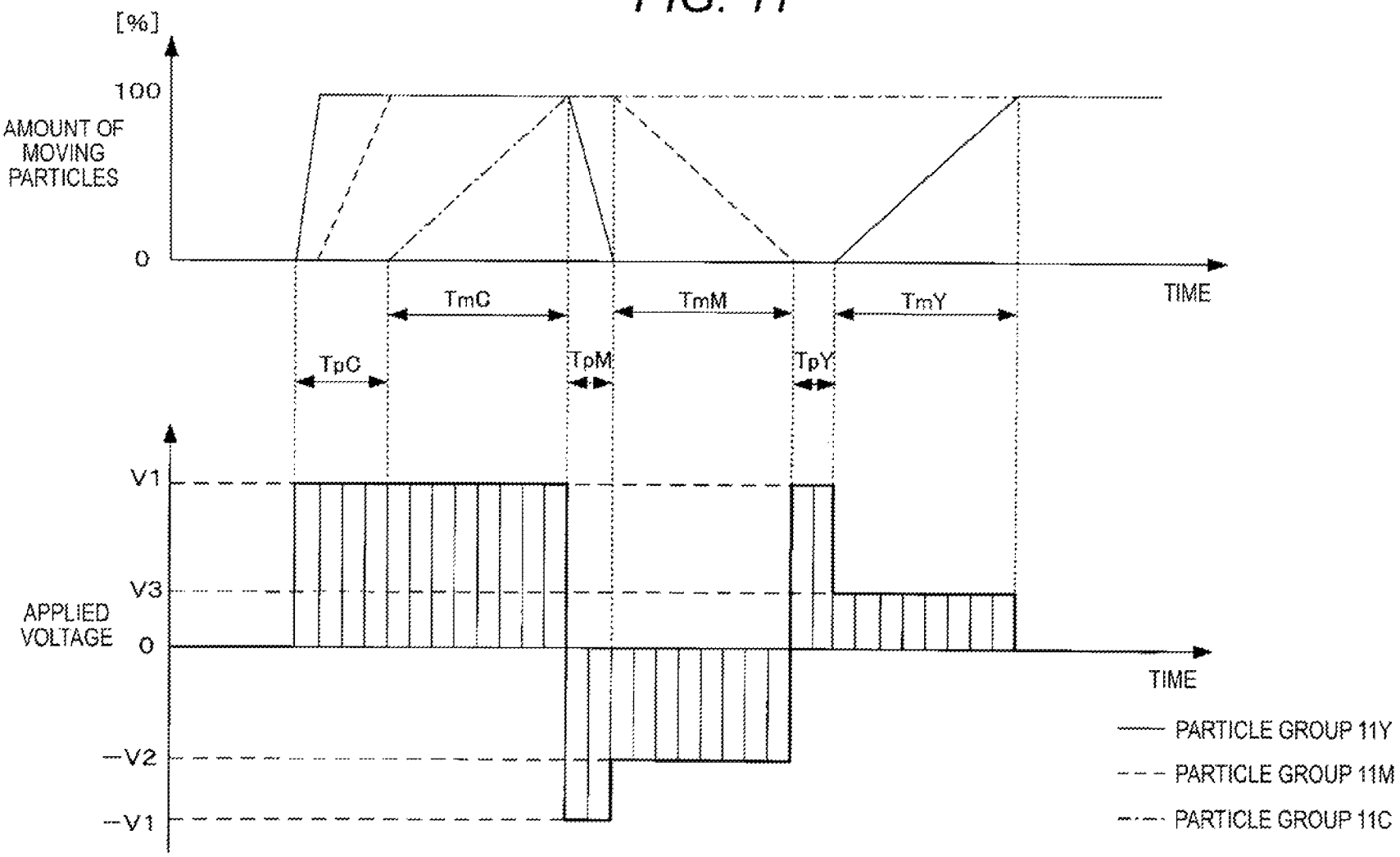
FIG. 11 is a timing chart of the driving process according to the second embodiment.

FIG. 11 is an example of the timing chart which illustrates the driving process described in FIG. 10 along the time axis and illustrates a timing of a driving process which controls gray levels of cyan and yellow as a maximum gray level and a gray level of magenta as a minimum gray level.

According to the second embodiment, differently from the first embodiment, a voltage value −V1 which is lower than the gray level adjusting voltage −V2 is applied as the preliminary voltage for the particle group 11M and a voltage value V1 which is higher than the gray level adjusting voltage V3 is applied as the preliminary voltage for the particle group 11Y.

Accordingly, as compared with a case when the preliminary voltage is set as a voltage value which is the same as the voltage value of the gray level adjusting voltage, it is expected that a time when the particle group having a threshold value lower than the threshold value of the particle group whose gray scale will be controlled is separated from one of the substrates 1 and 2 to move to the other substrate to be attached thereon and a time until the gray scale of the particle group whose gray scale will be controlled begins to be changed are shortened, so that re-writing time of the image is shortened.

Further, in the second embodiment, a voltage value |V1| of the gray level adjusting voltage for the particle group 11C which has the highest threshold value among the particle groups 11 is set as the voltage value of the preliminary voltage, but a voltage value which is larger than the voltage value |V1| may be set.

In this case, an effect that the re-writing time of the image is shortened is expected.

<Third Embodiment>

Next, referring to FIG. 12, an operation of the display device 100 when the driving process according to a third embodiment is performed will be described.

Figure 12:
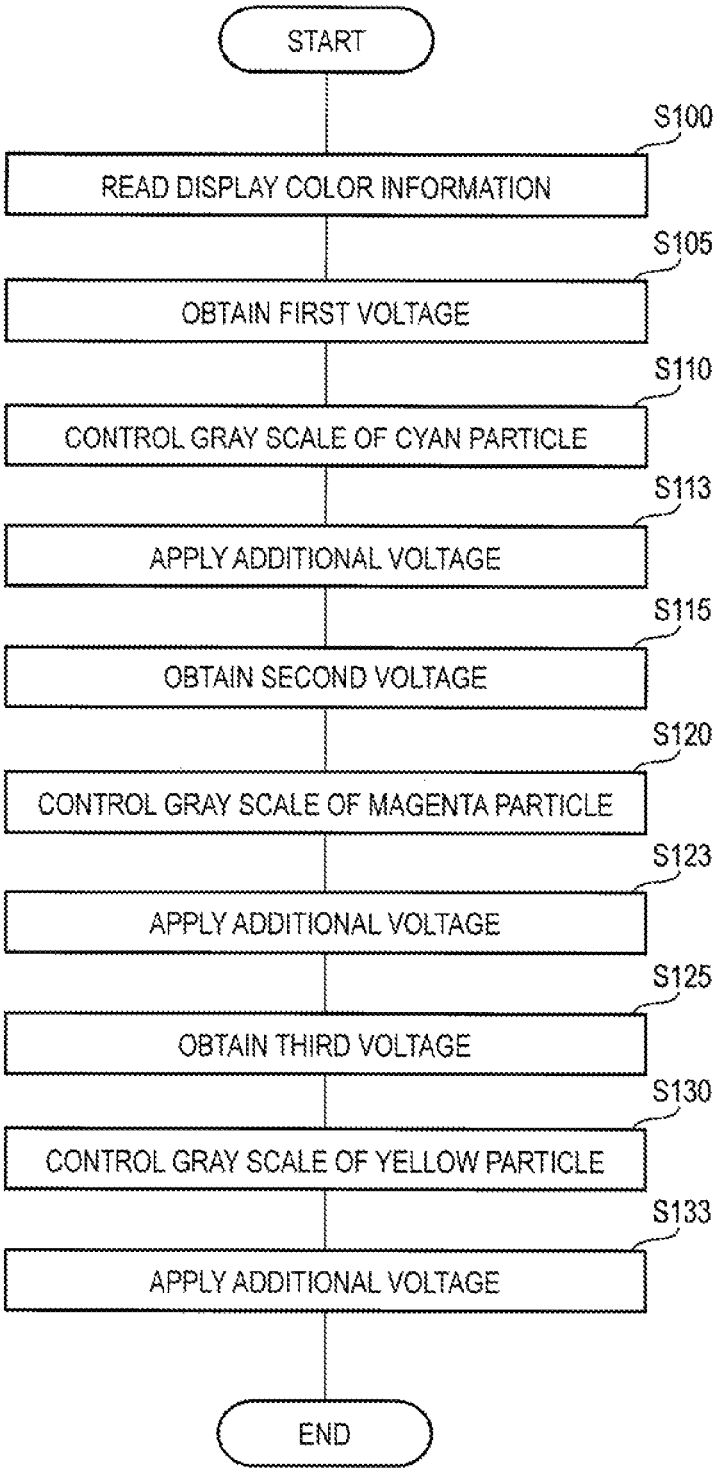
FIG. 12 is a flow chart of a driving process according to a third embodiment.

The third embodiment is different from the first embodiment in that a voltage for reliably attaching the particle group 11 on any one of the substrates 1 and 2 is further applied after applying the gray level adjusting voltage, but other processings and configuration are the same as those of the first embodiment FIG. 12 is a flow chart illustrating a flow of a processing of a driving program of a display medium 10 of the third embodiment which is executed by a CPU 401 of a display device 100 and the program is stored in a predetermined region of a ROM 402 in advance and executed by the CPU 401 whenever the image is requested to be displayed on the display medium 10.

Further, the difference from the flow chart of FIG. 6 according to the first embodiment is that steps S113, S123, and S133 are added.

As described above, in the process of step S110, a particle group 11M and a particle group 11Y are separated from a rear substrate 2 by a preliminary voltage V1 to be attached onto a display substrate 1 and a particle 11C of a particle group 11C in accordance with a gray scale designated by color information of an image is attached onto the display substrate 1 by a gray level adjusting voltage V1.

However, for example, when there is a variation in an attachment force of a particle 11 which is attached onto the display substrate 1, it is considered that a particle having a weak attachment force is separated from the display substrate 1 as time has elapsed, so that quality of an image to be displayed on the display medium 10 is deteriorated. Further, for example, even after completing the application of a gray level adjusting voltage V1, there may be a particle 11C which does not reach the display substrate 1 and moves in a dispersion medium 6.

Accordingly, in step S113, after applying the gray level adjusting voltage V1 between the electrodes 3 and 4, a time (hereinafter, referred to as an additional time) when a voltage (hereinafter, referred to as an additional voltage) for attaching the particle 11 onto any one of the substrates 1 and 2 is applied is obtained.

In the third embodiment, for example, a voltage value of the additional voltage is set to be the same voltage V1 as the gray level adjusting voltage and the additional time for the additional voltage V1 is obtained from, for example, an additional time table which is stored in a predetermine region of a non-volatile memory 404 in advance.

The additional time table is a table in which a relation between the additional voltage and the additional time is described and the table is determined by an experiment by the actual display device 100 or a computer simulation based on a design specification of the display device 100.

In the third embodiment, it is assumed that the additional time for the additional voltage V1 which is obtained from the additional time table is TaC. The additional voltage V1 is applied between the electrodes 3 and 4 for the additional time TaC.

Further, in the first embodiment, the process is in a standby status until a movement time TmCmax has elapsed in step S110, but in the third embodiment, in this step, the process is in a standby status until a gray level adjusting time TmC and the additional time TaC have elapsed so as not to proceed to next step S115.

In step S123, the same processing as step S113 is performed after applying a gray level adjusting voltage −V2 for the particle group 11M.

In this case, the additional voltage is set to be a voltage −V2 which is the same as the gray level adjusting voltage for the particle group 11M and an additional time for the additional voltage −V2 obtained from the additional time table is set to be TaM.

Further, in the first embodiment, the process is in a standby status until a movement time TmMmax has elapsed in step SI 20, but in the third embodiment, in this step, the process is in a standby status until a gray level adjusting time TmM and the additional time TaM have elapsed so as not to proceed to next step S125.

In step S133, the same processing as step S113 is performed after applying a gray level adjusting voltage V3 for the particle group 11Y.

In this case, the additional voltage is set to be the voltage V3 which is the same as the gray level adjusting voltage for the particle group 11Y and an additional time for the additional voltage V3 obtained from the additional time table is set to be TaY.

Further, in the first embodiment, the process is in a standby status until a movement time TmYmax has elapsed in step S130, but in the third embodiment, in this step, the process is in a standby status until a gray level adjusting time TmY and the additional time TaY have elapsed so as not to end the driving process.

Figure 13:
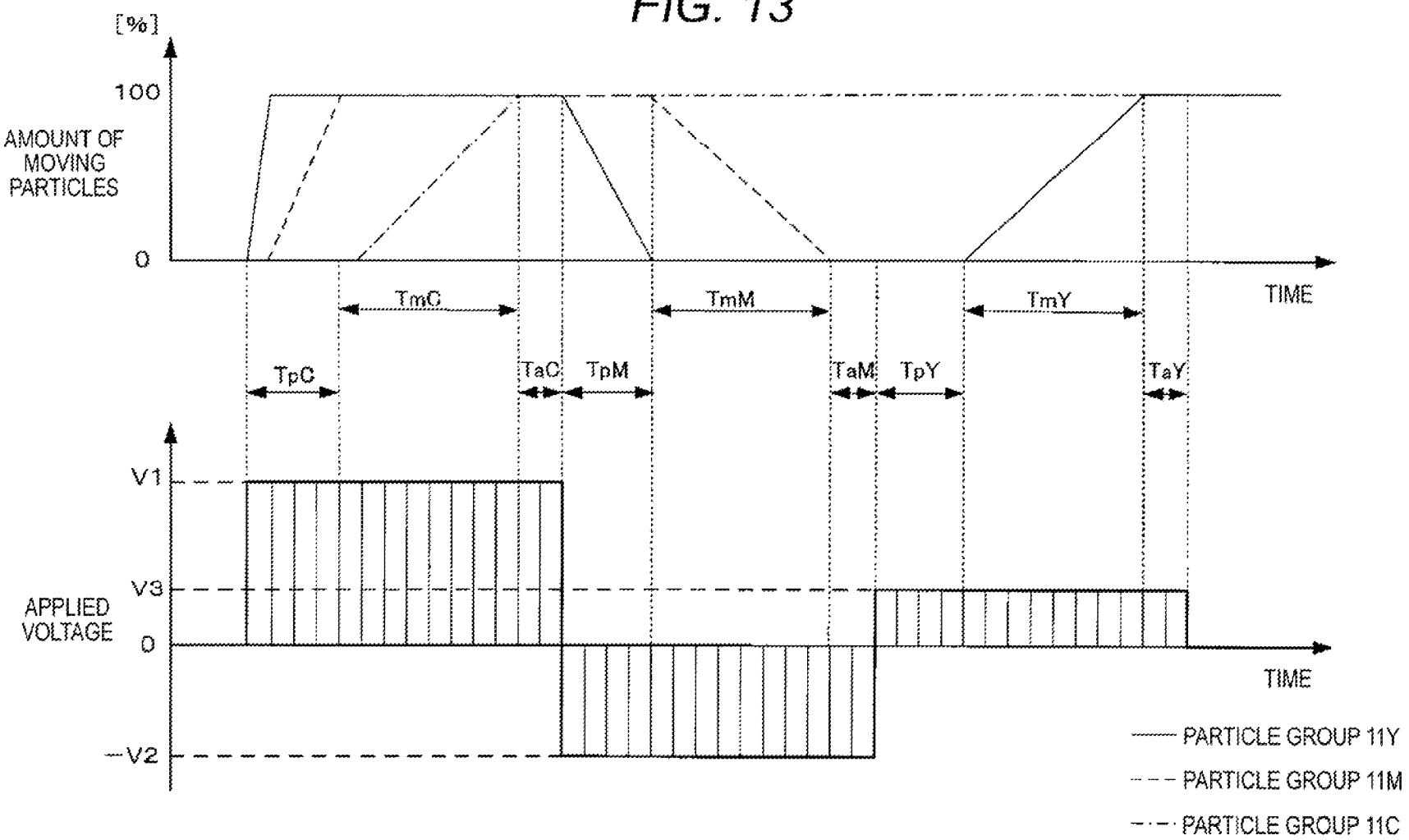
FIG. 13 is a timing chart of the driving process according to the third embodiment.

FIG. 13 is an example of the timing chart which illustrates the driving process described in FIG. 12 along the time axis and illustrates a timing of a driving process which controls gray levels of cyan and yellow as a maximum gray level and a gray level of magenta as a minimum gray level.

According to the third embodiment, the additional voltage V1 is applied during the additional time TaC between a gray level adjusting time TmC and a preliminary time TpM. Further, the additional voltage −V2 is applied for the additional time TaM between a gray level adjusting time TmM and a preliminary time TpY. In addition, the additional voltage V3 is applied during the additional time TaY after the gray level adjusting time TmY.

Therefore, when a gray scale is controlled, as compared with a case when the additional voltage is not applied after applying the gray level adjusting voltage, the particle 11 which is attached onto any one of the substrates 1 and 2 is more reliably attached onto the substrate and a particle 11 which floats in the dispersion medium 6 is attached onto any one of the substrates 1 and 2 so that an effect that display quality of the image is improved is expected.

Further, in the third embodiment, even though the additional voltage is set to be equal to the gray level adjusting voltage which has been applied immediately before applying the additional voltage, the additional voltage may be set to be lower than the gray level adjusting voltage which has been applied immediately before applying the additional voltage.

Specifically, when a display gray level of the particle group 11 whose gray scale will be controlled is a minimum gray level or a maximum gray level, that is, in the case of a binary gray scale, the additional voltage may be set to be equal to the gray level adjusting voltage which has been applied immediately before applying the additional voltage. When the display gray level of the particle group 11 whose gray scale will be controlled is higher than the minimum gray level and lower than the maximum gray level, that is, in the case of an intermediate gray scale, the additional voltage may be set to be lower than the gray level adjusting voltage which has been applied immediately before applying the additional voltage (equal to or lower than a voltage at which the particle is not separated from the substrate).

This is because, when the particle group 11 whose gray scale will be controlled is controlled at the intermediate gray scale, if the additional voltage is set to be equal to the gray level adjusting voltage, particles with an amount equal to or more than the amount of particles in accordance with the intermediate gray scale are separated from any one of the substrates 1 and 2 by the additional voltage so that the display quality of the image is deteriorated.

Further, the additional voltage may be applied in the example of the second embodiment.

<Fourth Embodiment>

Figure 14:
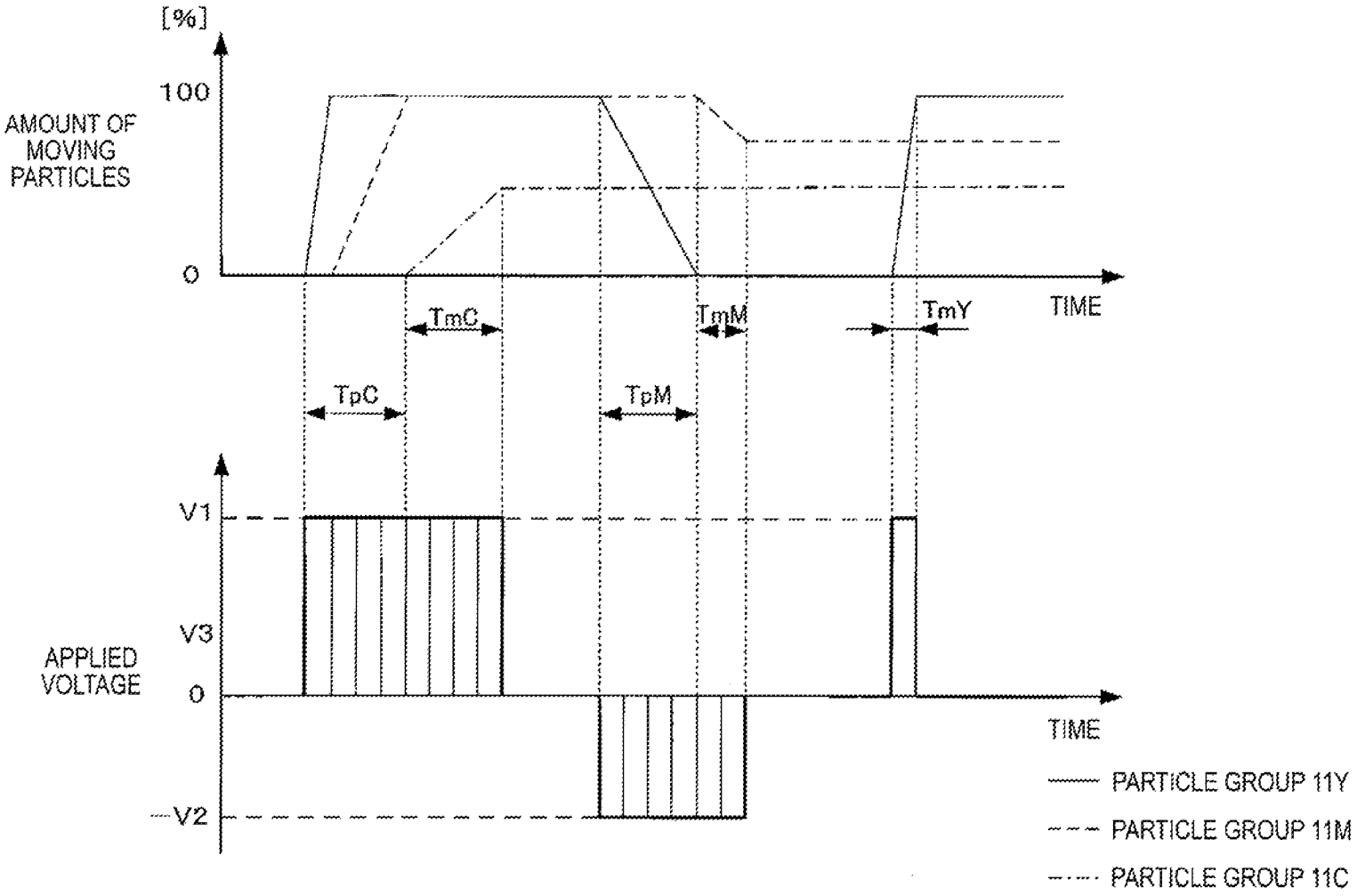
FIG. 14 is a timing chart of a driving process according to the fourth embodiment.

Next, referring to FIG. 14, an operation of the display device 100 when the driving process according to a fourth embodiment is performed will be described.

The fourth embodiment is different from the first embodiment in that setting of a gray level adjusting voltage is changed depending on whether to control the particle group 11 at an intermediate gray scale or a binary gray scale, but other processes and configuration are the same as the first embodiment.

A flow of the process of a driving program of a display medium 10 according to the fourth embodiment is the same as in FIG. 6 which illustrates the flow of the process of the driving program of the display medium 10 according to the first embodiment.

As an example of the fourth embodiment, cyan and magenta are controlled at an intermediate gray scale and yellow is controlled at the maximum gray level. FIG. 14 is a timing chart illustrating the driving process in this case along a time axis.

The gray scales of cyan and magenta are controlled by steps S100 to step S120 of FIG. 6. However, in step S125, if a gray scale of yellow designated by color information of an image obtained in step S100 is a binary gray scale, a gray level adjusting voltage for a particle group having the highest threshold value among the particle groups 11 is set as a third voltage. In the fourth embodiment, the gray level adjusting voltage V1 for the particle group 11C is set as the third voltage.

In step S130, the third voltage V1 is set as the gray level adjusting voltage for the particle group 11Y. When the gray level adjusting voltage V1 is applied, a gray level adjusting time TmY which adjusts the particle group 11Y to have the maximum gray level is obtained from a gray level adjusting time table. The gray level adjusting voltage V1 is applied between the electrodes 3 and 4 for the gray level adjusting time TmY.

In the first embodiment, the gray level adjusting voltage for the particle group 11Y is set to be lower than the gray level adjusting voltage for the particle group 11C so as to equalize the movement times of the colors C, M, and Y. However, in the fourth embodiment, the gray level adjusting voltage for the particle group 11Y is set to be a voltage V1 which is equal to the gray level adjusting voltage for the particle group 11C so that a time required to change a display gray level of the particle group 11Y from the minimum gray level to the maximum gray level is shortened from the movement time TmYmax to the gray level adjusting time TmY.

Therefore, as compared with the first embodiment, an effect that the re-writing time of the image is shortened is expected.

Further, like the fourth embodiment, for example, when the display gray level of any type of particle group of the particle groups 11 is changed from the minimum gray level to the maximum gray level, a particle group having a threshold value which is lower than that of a particle group whose gray scale is controlled to be the binary gray scale is separated from any one of the substrates 1 and 2 and attached onto the other one during the gray level adjusting time so that the preliminary voltage may not be provided.

Further, as described in the third embodiment, after the gray level adjusting times TmC, TmM, and TmY, an additional period when the additional voltage is applied may also be provided.

Further, in the fourth embodiment, a voltage value |V1| of the gray level adjusting voltage for the particle group 11C which has the highest threshold value among the particle groups 11 is set as the voltage value of the gray level adjusting voltage when the gray scale is controlled to be the binary gray scale, but a voltage value which is larger than the voltage value |V1| may be set.

In this case, an effect that the re-writing time of the image is shortened is expected.

<Fifth Embodiment>

Next, referring to FIG. 15, an operation of the display device 100 when the driving process according to a fifth embodiment is performed will be described.

In the first to fourth embodiments, in order to equalize the gray scale numbers which may be obtained by the particle groups included in the particle group 11, as the threshold value of the particle group among the particle groups 11 becomes lower, the voltage value of the gray level adjusting voltage is adjusted to be lower. Further, the numbers of unit pulses included in the movement time of the particle groups are set to be equal.

In contrast, in the fifth embodiment, without adjusting the voltage value of the gray level adjusting voltage of the particle group 11, the gray scale numbers which may be obtained by the particle groups included in the particle groups 11 are set to be equal by adjusting the width of the unit pulse included in the gray level adjusting voltage.

Further, a configuration of the display device 100 is the same as that of the first embodiment.

Figure 15:
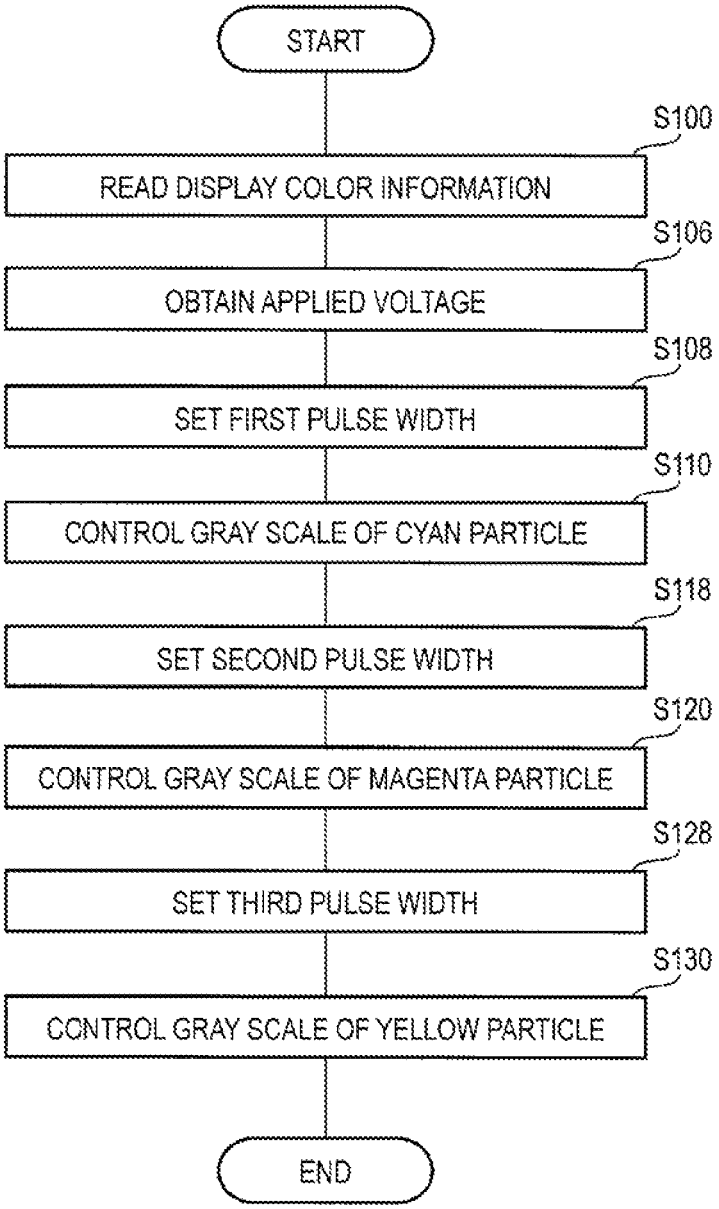
FIG. 15 is a flow chart of a driving process according to a fifth embodiment.

FIG. 15 is a flow chart illustrating a flow of a processing of a driving program of a display medium 10 of the fifth embodiment which is executed by a CPU 401 and the program is stored in a predetermined region of a ROM 402 in advance and executed by the CPU 401 whenever the image is requested to be displayed on the display medium 10.

Further, the flow chart of FIG. 15 is different from the flow chart of FIG. 6 in the first embodiment in that step S106 is added, step S105 of the first embodiment is replaced with step S108, step S115 of the first embodiment is replaced with step S118, and step S125 of the first embodiment is replaced with step S128.

In step S106, for example, an applied voltage which is stored in a predetermined region of a non-volatile memory 404 in advance and is applied when the gray scale of the particle group included in the particle groups 11 is controlled is obtained.

The applied voltage is set as a voltage at which a particle group 11C having the highest threshold value among the particle groups 11 is separated from any one of the substrates 1 and 2 and attached onto the other substrate, for example, a voltage V1, but is not limited thereto.

In step S108, a movement time TmCmax of the particle group 11C when the applied voltage V1 is set to the gray level adjusting voltage is obtained from a gray level adjusting time table.

Also, a unit pulse width that achieves a predetermined gray scale number (hereinafter, referred to as a prescribed gray scale number) which may be represented by the display medium 10 at the movement time TmCmax is set. For example, when the movement time TmCmax is 0.1 s and the prescribed gray scale number is six steps, the unit pulse width is set to 0.02 s. The set unit pulse width is notified to a voltage applying unit 30.

The voltage applying unit 30 receives the notification from the control unit 40 and adjusts the unit pulse width of the voltage which is applied between the electrodes 3 and 4 to an indicated value.

Further, the voltage applying unit 30 according to the fifth embodiment may adjust the unit pulse width to 1 Ms as an example. However, when the unit pulse width is set to be lower than 10 Ms, the particle group included in the particle groups 11 hardly moves in accordance with the application of the voltage as the unit pulse width becomes shorter. Therefore, the unit pulse width is desirably adjusted to be 10 Ms or higher.

In step S110, first, a preliminary time TpC when the applied voltage V1 obtained in step S106 is set as a preliminary voltage is obtained from a preliminary time table and the preliminary voltage V1 is applied between the electrodes 3 and 4 during the preliminary time TpC and then, the gray level adjusting voltage V1 is applied during a gray level adjusting time TmC to control the gray scale of the particle group 11C.

Here, the gray level adjusting time TmC is a time obtained by multiplying the unit pulse width set in step S108 by the number of the unit pulses in accordance with a gray scale of cyan designated by color information of an image obtained in step S100.

In step S118, similarly to step S108, a movement time TmMmax of the particle group 11M when the applied voltage −V1 is set to the gray level adjusting voltage is obtained from a gray level adjusting time table. The unit pulse width which achieves the prescribed gray scale number is set at the movement time TmMmax and the unit pulse width of the voltage applying unit 30 is adjusted.

In this case, TmMmax<TmCmax so that the unit pulse width set in step S118 is smaller than the unit pulse width set in step S108.

In step S120, similarly to step S110, a gray level adjusting voltage −V1 is applied during a gray level adjusting time TmM after applying a preliminary voltage −V1 during a preliminary time TpM to control the gray scale of the particle group 11M.

In step S128, similarly to step S108, a movement time TmYmax of the particle group 11Y when the applied voltage V1 is set to the gray level adjusting voltage is obtained from a gray level adjusting time table. The unit pulse width which achieves the prescribed gray scale number is set at the movement time TmYmax and the unit pulse width of the voltage applying unit 30 is adjusted.

In this case, TmYmax<TmMmax so that the unit pulse width set in step S128 is smaller than the unit pulse width set in step S118.

In step S130, similarly to step S110, a gray level adjusting voltage V1 is applied during a gray level adjusting time TmY after applying a preliminary voltage V1 during a preliminary time TpY to control the gray scale of the particle group 11Y.

Figure 16:
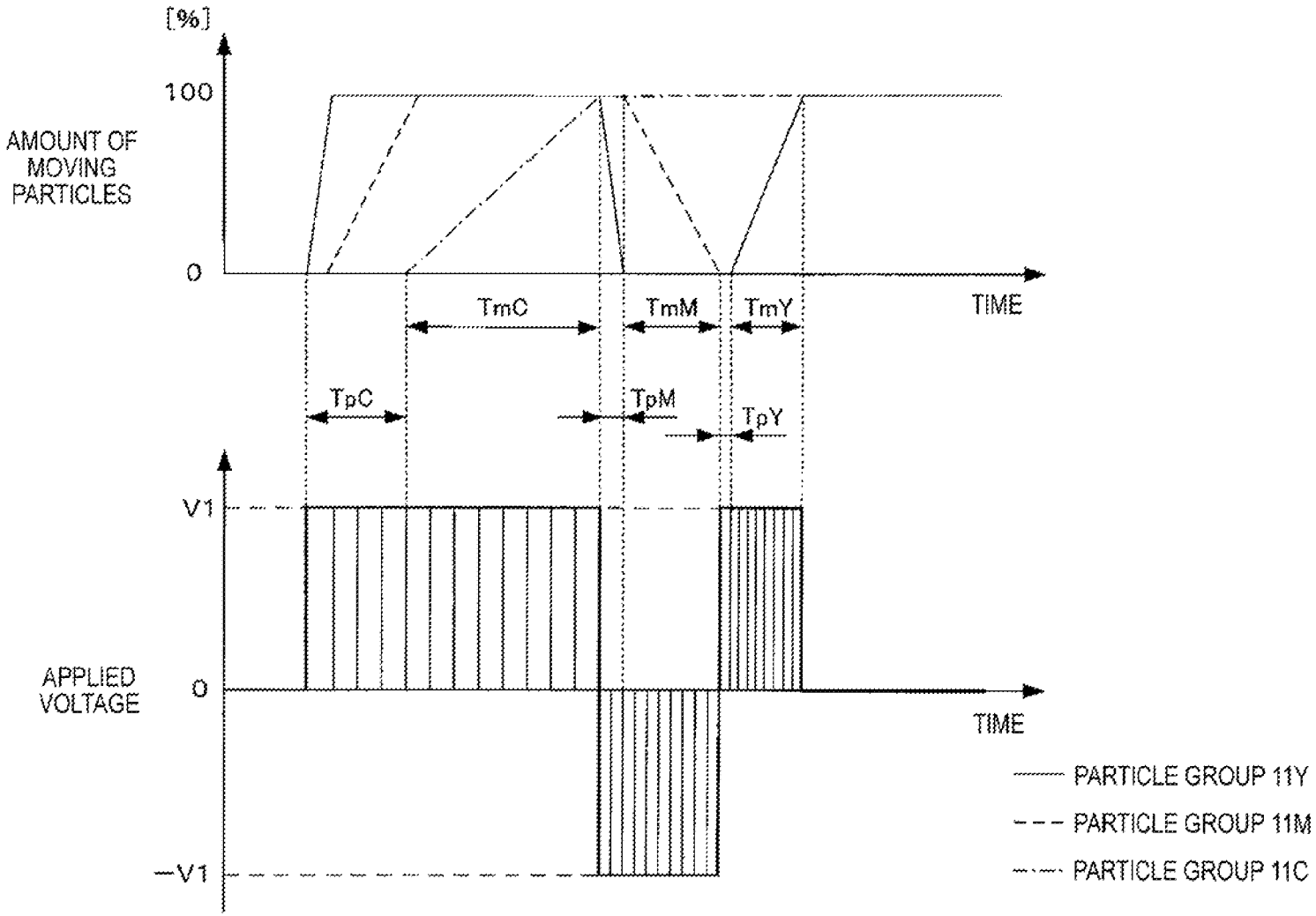
FIG. 16 is a timing chart of the driving process according to the fifth embodiment.

FIG. 16 is the timing chart which illustrates the driving process described in FIG. 15 along the time axis and illustrates a timing of a driving process which controls gray levels of cyan and yellow as a maximum gray level and a gray level of magenta as a minimum gray level, as an example.

Further, as described in the third embodiment, after the gray level adjusting times TmC, TmM, and TmY, an additional period when the additional voltage is applied may be provided.

As described above, according to the fifth embodiment, the lower threshold value of the particle group among the particle groups 11, the shorter the unit pulse width which configures the gray level adjusting voltage, so that the number of unit pulses included in the movement time is increased so that a gray scale number is equal to the gray scale number which may be obtained by the particle group having the highest threshold value among the particle groups 11.

Further, in the fifth embodiment, the voltage values of the preliminary voltages and the gray level adjusting voltages for particle groups included in the particle groups 11 are set to be equal to each other, but the voltage values of the preliminary voltage and the gray level adjusting voltage may vary and the unit pulse width may also be adjusted, for every particle group included in the particle groups 11.

In this case, if the voltage value of the gray level adjusting voltage is set to be lower to the particle group having a lower threshold value, the unit pulse width of the gray level adjusting voltage for the particle group having a lower threshold value may be increased as compared with a case when the gray level adjusting voltages for the particle groups included in the particle group 11 are fixed.

Therefore, when the gray level adjusting voltages for the particle groups included in the particle groups 11 are fixed, it is possible to cope with a case where the unit pulse width which equalizes the gray scale numbers exceeds an adjusted threshold value of the unit pulse width in the voltage applying unit 30.

As described above, the present invention has been described using embodiments but a technical scope of the present invention is not limited to the scope of the above-described embodiment. Various changes and modification may be made in the above-described embodiments without departing from the gist of the present invention and the changes and the modification are also included in the technological scope of the present invention.

In the embodiments of the present invention, plural types of particle groups having different movement times are encapsulated in a partition. However, even when the particle groups having different movement times are distinguished to be encapsulated in every partition, the same effect of the present invention may be obtained. Further, even when a dispersion medium which includes the particle groups having different movement times is encapsulated in a micro capsule without using the gap member 5, the same effect of the present invention may be obtained.

Further, in the first to fifth embodiments, it is described that the driving process is accomplished by a software configuration but the present invention is not limited thereto. For example, the driving process may be accomplished by a hardware configuration.

As an example of the above case, for example, a functional device which performs the same processing as the control unit 40 is created to be used. In this case, as compared with the embodiments, speed-up of the processing is expected.

Further, in a response preferential mode which gives a priority to a re-writing speed of an image rather than display quality of an image, for example, a higher voltage as possible is applied at the time of driving control for the particle group 11. In an image quality preferential mode which gives a priority to display quality of the image rather than the rewriting speed of an image, the driving control described in the first to fifth embodiments may be performed on the particle groups 11. As an appropriate example which is switched to the response preferential mode, for example, there is a so-called page turning process which changes an image displayed on the display medium 10 into a different image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A driving device of a display medium, comprising:

an applying unit that applies a gray level adjusting voltage including unit pulses in accordance with a gray level of a pixel to the pixel of a display medium in which plural types of particle group are encapsulated, the plural types of particle groups having:

different colors, different movement times when the particle groups move from one of a pair of substrates to the other substrate, and when an intensity of an electric field is fixed, and different threshold values at which the particle groups begin to move between the pair of substrates depending on the electric field formed between the pair of substrates in which at least one of the substrates is translucent; and a control unit that controls the applying unit so that the number of unit pulses of the gray level adjusting voltage which is applied at the movement time of each of the plural types of particle groups is equal to the number of unit pulses of the gray level adjusting voltage which is applied at the movement time of a particle group having the highest threshold value among the plural types of particle groups.

2. The driving device of claim 1, wherein the control unit controls the applying unit so that the lower the threshold value of the particle group among the plural types of particle groups, the lower the voltage value of the gray level adjusting voltage for the particle group.

3. The driving device of claim 1, wherein the control unit controls the applying unit to apply a preliminary voltage at which a particle group having a threshold value lower than the threshold value of the particle group whose gray level will be adjusted, among the plural types of particle groups is separated from any one of the pair of substrates and attached onto the other substrate, before applying the gray level adjusting voltage.

4. The driving device of claim 3, wherein the control unit controls the applying unit so that a voltage value of the preliminary voltage is equal to or higher than a voltage value of the gray level adjusting voltage for the particle group having the highest threshold value among the plural types of particle groups.

5. The driving device of claim 1, wherein the control unit controls the applying unit to apply an additional voltage which is equal to or lower than a voltage value of the gray level adjusting voltage, after applying the gray level adjusting voltage.

6. The driving voltage of claim 5, wherein the control unit controls the applying unit so as to set a voltage value of the additional voltage to be equal to the voltage value of the gray level adjusting voltage when a gray level of the pixel is a minimum gray level or a maximum gray level and set the voltage value of the additional voltage to be lower than the voltage value of the gray level adjusting voltage when a gray level of the pixel is higher than the minimum gray level and lower than the maximum gray level.

7. The driving device of claim 1, wherein the control unit controls the applying unit so that the lower the threshold value of the particle group among the plural types of particle groups, the shorter the width of the unit pulse.

8. A non-transitory computer readable medium storing a program causing a computer to function as the control unit of the driving device according to claim 1.

9. A display device, comprising:

the display medium; and the driving device of the display medium of claim 1.

* * * * *